US006516887B2

(12) United States Patent
Nguyen et al.

(10) Patent No.: US 6,516,887 B2
(45) Date of Patent: Feb. 11, 2003

(54) METHOD AND APPARATUS FOR TENSIONING TUBULAR MEMBERS

(75) Inventors: Dennis P. Nguyen, Houston, TX (US); Delbert E. Vanderford, Cypress, TX (US)

(73) Assignee: Cooper Cameron Corporation, Houston, TX (US)

( * ) Notice: Subject to any disclaimer, the term of this patent is extended or adjusted under 35 U.S.C. 154(b) by 38 days.

(21) Appl. No.: 09/770,416

(22) Filed: Jan. 26, 2001

(65) Prior Publication Data

US 2002/0100596 A1 Aug. 1, 2002

(51) Int. Cl.[7] ..... E21B 29/12; E21B 23/00

(52) U.S. Cl. ..... 166/348; 166/382; 166/378; 166/208

(58) Field of Search ..... 166/348, 368, 166/382, 75.14, 367, 378, 381, 208, 212

(56) References Cited

U.S. PATENT DOCUMENTS

| | | | | |
|---|---|---|---|---|
| 4,794,988 A | | 1/1989 | Van Bilderbeek | 166/345 |
| 4,909,546 A | * | 3/1990 | Nobileau | 166/206 |
| 4,938,289 A | | 7/1990 | Van Bilderbeek | 166/342 |
| 4,949,786 A | * | 8/1990 | Eckert et al. | 166/208 |
| 4,995,464 A | | 2/1991 | Watkins | 166/382 |
| 5,176,218 A | | 1/1993 | Singer | 166/206 |
| 5,255,746 A | * | 10/1993 | Bridges | 166/348 |
| 5,439,061 A | | 8/1995 | Brammer | 166/368 |
| 5,450,904 A | | 9/1995 | Galle | 166/348 |
| 5,524,710 A | | 6/1996 | Shinn | 166/348 |
| 5,638,903 A | | 6/1997 | Kent | 166/348 |
| 5,653,289 A | | 8/1997 | Hosie | 166/348 |
| 5,671,812 A | | 9/1997 | Bridges | 166/348 |
| 5,944,111 A | | 8/1999 | Bridges | 166/348 |
| 6,202,745 B1 | * | 3/2001 | Reimert et al. | 166/115 |

* cited by examiner

*Primary Examiner*—Robert E. Pezzuto
*Assistant Examiner*—Thomas A. Beach
(74) *Attorney, Agent, or Firm*—Michael P. Hartmann; Peter A. Bielinski

(57) ABSTRACT

An apparatus for securing a tubular member under tension is provided, the member secured to and extending between a first and second fixed assembly. The apparatus comprises a first tubular assembly connectable at a first region to the tubular member to be tensioned and a second tubular assembly having a first and a second engageable portion, the second tubular assembly being arranged concentrically with respect to the first tubular assembly and movable longitudinally with respect to the first tubular assembly. A first engagement assembly is provided for engaging the first engageable portion of the second tubular assembly with the first fixed assembly, such that movement of the second tubular assembly toward the tubular member to be tensioned is prevented. A second engagement assembly is provided for engaging the second engageable portion of the second tubular assembly with the first tubular assembly upon longitudinal movement of the second engageable portion of the second tubular assembly with respect to the first tubular assembly toward the tubular member. In this way, the second tubular assembly can be placed under tension by moving its second engageable portion longitudinally relative to its first engageable portion, when the first engageable portion is engaged with the first fixed assembly. A method for securing a tubular member, together with a tool for installing the apparatus, is also enclosed.

20 Claims, 4 Drawing Sheets

METHOD AND APPARATUS FOR TENSIONING TUBULAR MEMBERS

TECHNICAL FIELD OF THE INVENTION

The present invention relates to an apparatus for applying tension to a tubular member and to a method of using the same. In particular, the present invention relates to an apparatus for tensioning tubular members used in offshore oil and gas drilling and production operations, for example the legs of tensions leg platforms, casing strings and risers, and a method for carrying out the same.

BACKGROUND OF THE INVENTION

Many situations require a tubular member to be placed under tension. Such situations arise in many different aspects of the operations for exploration, drilling and production of oil and gas, in particular in offshore locations. Examples of situations requiring tubular members to be tensioned include the setting of tension leg platforms for offshore drilling and production operations. Further examples arise in the drilling and production of oil and gas from wells accessed through wellheads located on the sea floor, and include the tensioning of risers and casing strings extending between a hanger located in a wellhead on the seabed and a wellhead mounted on a platform or vessel at the surface.

U.S. Pat. No. 4,794,988 discloses a surface wellhead apparatus for use in tying back casings extending to a subsea structure. The casing is held under tension by a lock member which engages on a shoulder within the surface wellhead. A similar arrangement is described in U.S. Pat. No. 4,938,289. Both arrangements require the casing string to be first placed under tension, after which the casing may be held in tension using the arrangements disclosed.

U.S. Pat. No. 4,995,464 describes an offshore well installation in which an adjustable assembly is employed to tension a casing string or other tubular member. The installation comprises a first tubular member and a second tubular member arranged concentrically with a sleeve disposed therebetween. The sleeve is formed with an inner and outer thread thereon, engaging with corresponding outer and inner threads on the first and second tubular members. A lug is disposed between the first and second tubular members to prevent relative rotation of one against the other. Rotation of the sleeve moves the first and second sleeves longitudinally with respect to one another, thus allowing a tension to be placed on the casing string. While the arrangement can be operated to apply tension to the casing string without requiring the string to be tensioned by other means, this is only possible by rotation of the sleeve.

U.S. Pat. No. 5,638,903 discloses an adjustable mandrel hanger system for maintaining tension in a string of casing extending between a subsea wellhead assembly and a surface wellhead housing. A mandrel is secured to the end of the casing string, to which is mounted a locking member. The locking member lands against a shoulder in the wellhead housing. Upon installation, the operator applies tension to the casing string. The mandrel moves upwards relative to the locking member as the tension is applied. Upon release of the tension applied by the operator, the locking member will retain the mandrel and the string under tension against the shoulder. It is to be noted that the hanger system of U.S. Pat. No. 5,638,903 simply holds a casing string under tension, once the tension has been applied by the operator. The hanger system cannot itself be used to apply tension to the casing string.

U.S. Pat. No. 5,653,289 discloses a casing tensioning system for applying tension to a string of casing between a subsea wellhead and a surface wellhead. A casing hanger is secured to the casing: string. The casing hanger has a first position, allowing downward movement of the casing string with respect to the hanger, and a second position, in which upward movement of the casing string is allowed, but in which downward movement of the string relative to the hanger is prevented. The hanger is landed on a shoulder within the surface wellhead. The operator applies tension to the casing string, after which the casing hanger acts to retain the casing string under tension. Again, while the apparatus disclosed is sufficient to hold the tensioned casing string, it cannot be operated to apply the required tension to the string or another tubular member.

A similar arrangement is described in U.S. Pat. No. 5,671,812, in which a casing hanger is secured to a mandrel, the mandrel in turn being attached to a casing string to be tensioned. Again, the casing hanger allows upwards movement of the mandrel with respect to the hanger, but prevents relative downward movement of the mandrel. Hydraulic pressure is used to force the casing hanger to seat against a shoulder within the surface wellhead, after which the mandrel is raised, thereby placing the casing string under tension. As with the earlier designs discussed above, the casing hanger, while retaining the casing string under tension once sufficient tension has been applied, does not act itself to apply tension to the casing string.

An arrangement similar to that of U.S. Pat. No. 5,671,812 is disclosed in U.S. Pat. No. 5,944,111, with the difference that a launch adaptor is used to force the casing hanger against the shoulder in the surface wellhead, after which tension is applied to the casing. The casing hanger acts to retain the string of casing under tension in a similar manner to that described in U.S. Pat. No. 5,671,812.

It can be seen that a variety of assemblies have been proposed to retain a tubular member, such as a casing string, under tension between two fixed assemblies. However, in such arrangements, it is necessary to provide additional means to place the tubular member under the required tension. U.S. Pat. No. 4,995,464 discloses an arrangement in which a single assembly is employed to both apply tension to a tubular member, in this instance a casing string, and retain the tubular member under tension, once applied. However, this arrangement only operates by the interaction of a plurality of separate threads formed on various of the tubular components. The machining of threads is time consuming and undesirable.

Accordingly, it can be seen that there is a need for an assembly which can be attached to a tubular member, such as a string of casing in an offshore well, and operated to both apply tension to the tubular member and retain the member under tension, once applied, by linear movement of the components of the assembly and without the need for components to be rotated or formed with threads.

SUMMARY OF THE INVENTION

According to a first aspect of the present invention, there is provided an apparatus for securing a tubular member under tension, the member secured to and extending between a first and second, fixed assembly, the apparatus comprising:

- a first tubular assembly connectable at a first engageable portion to the tubular member to be tensioned;
- a second tubular assembly having a first and a second engageable portion, the second tubular assembly being arranged concentrically with respect to the first tubular assembly and movable longitudinally with respect to the first tubular assembly;

a first engagement assembly for engaging the first engageable portion of the second tubular assembly with the first fixed assembly, such that movement of the second tubular assembly toward the tubular member to be tensioned is prevented;

a second engagement assembly for engaging the second engageable portion of the second tubular assembly with the first tubular assembly upon longitudinal movement of the second engageable portion of the second tubular assembly with respect to the first tubular assembly toward the first engageable portion of the first tubular assembly;

wherein the second tubular assembly can be placed under tension by moving its second engageable portion longitudinally relative to its first engageable portion, when the first engageable portion is engaged with the first fixed assembly.

When the first tubular assembly is attached to a tubular member, such as a casing string or riser, longitudinal movement of the second engageable portion of the second tubular assembly toward the tubular member applies tension to the second tubular assembly, in turn tensioning the tubular member. The apparatus of the present invention may thus be installed to secure an end of the tubular member, for example a casing string or riser, to a first fixed assembly, for example a surface wellhead. Once the tubular member has been attached to the second fixed assembly, for example a subsea wellhead, the apparatus may also be used to tension the tubular member, without the need for additional tensioning equipment. The tension is applied by moving the second engageable portion of the second tubular assembly in a longitudinal direction and, thus, does not require any of the components to be rotated or be formed with any additional threaded sections, other than those conventionally found in such systems. This is turn allows the apparatus to be manufactured in a simple manner.

In a preferred embodiment, the second engageable portion of the second tubular assembly extends concentrically within the first tubular assembly.

The first engagement assembly comprises a locking collar, the locking collar for engaging a shoulder in the first fixed assembly. In this arrangement, the locking collar simply bears against the shoulder, in order to prevent the second tubular assembly from moving towards the tubular member to be secured and tensioned. The first engagement assembly may further comprise a locking ring, for engaging a groove in the first fixed assembly. The locking ring may be biased into engagement with the groove. In an alternative arrangement, the locking collar is movable longitudinally with respect to the second tubular assembly upon contact with the shoulder in the first fixed assembly, such movement urging the locking ring into engagement with the groove in the first fixed assembly.

Preferably, the second engagement assembly allows the second engageable portion of the second tubular assembly, when engaged with the first tubular assembly, to move away from the first engageable portion of the second tubular assembly.

In a preferred embodiment, the second engagement assembly allows the second engageable portion of the second tubular assembly to engage with the first tubular assembly in one of a plurality different positions. This arrangement allows the tension being applied to the tubular member to be varied, while still allowing the first and second tubular assemblies to engage, in turn securing the tubular member to the first fixed assembly.

Preferably, the second engagement assembly has a first operating mode, in which engagement between the first and second tubular assemblies is not possible, and a second operating mode, in which engagement between the first and second tubular assemblies is possible. In this way, the second engagement assembly may be held inoperative, until the necessary steps have been taken to secure the apparatus to the tubular member to be secured and tensioned and until the second tubular assembly has been engaged with the first fixed assembly by the first engagement assembly. Most preferably, the second engagement assembly is moved from the first operating mode to the second operating mode upon the application of a predetermined tension to the second tubular assembly.

In a specific embodiment of the apparatus of the present invention the second engagement assembly comprises a first groove in the first tubular assembly and a second groove in the second tubular assembly, the second engagement assembly further comprising a locking ring for engaging both the first groove and the second groove. Preferably, a plurality of first grooves are provided, thereby allowing the second engageable portion of the second tubular assembly to engage the first tubular assembly in a plurality of different positions. The locking ring of the second engagement assembly may be held completely within the second groove in the second tubular assembly until a predetermined tension is applied to the second tubular assembly.

A tensioning collar may be provided in the second tubular assembly at its second engageable portion, the tensioning collar being engageable by a tool for tensioning the second tubular assembly. If present, the tensioning collar is preferably movable between a first position, in which the tensioning collar holds the locking ring completely within the second groove, and a second position, in which the locking ring is released to engage the first groove. The locking ring is preferably biased into engagement with the first groove, the tensioning collar holding the locking ring against its bias in the first position. The tensioning collar may be arranged to move from the first position into the second position at a predetermined tension applied to the second tubular assembly.

The apparatus of the present invention may be used to secure and tension tubular members in general. However, the apparatus finds particularly advantageous application in the securing and tensioning of casing string, risers, and the legs of a tension leg platforms.

In a further aspect, the present invention provides a method for securing and tensioning a tubular member, the tubular member extending between a first fixed assembly and a second fixed assembly, the method comprising:

securing a first tubular assembly to the tubular member;

providing a second tubular assembly, having a first engageable portion and a second engageable portion;

securing the second tubular assembly at its first engageable portion to the first fixed assembly, such that the first tubular assembly is prevented from moving towards the tubular member;

applying tension to the second tubular assembly by moving the second engageable portion away from the first engageable portion by applying a force longitudinally to the second tubular assembly;

engaging the second engageable portion of the second tubular assembly with the first tubular assembly.

The second tubular assembly is preferably moved longitudinally from a disengaged position to an engaged position, in which the second tubular assembly is engaged with the first fixed assembly, the longitudinal movement of the second tubular assembly being continued to tension the second tubular assembly and engage the second tubular assembly with the first tubular assembly.

It is advantageous if the engagement of the second engageable portion of the second tubular assembly is carried out selectively, when the second tubular assembly has been position appropriately with respect to the first tubular assembly, prior to which the engagement of the two assemblies not being possible. In a preferred embodiment, the second engageable portion of the second tubular assembly is engaged with the first tubular assembly upon application of a predetermined tension to the second tubular assembly.

Preferably, an engagement assembly is provided to engage the second engageable portion of the second tubular assembly with the first tubular assembly, the engagement assembly being biased into an engaged position, the engagement assembly being held in a disengaged position until application of the predetermined tension to the second tubular assembly.

In a preferred embodiment, the second engageable portion of the second tubular assembly is engageable with first tubular member in a plurality of positions. In this way, the tension applied to the tubular member may be varied, as required by the prevailing circumstances.

In a further aspect, the present invention provides an apparatus for use as a tool for securing and tensioning a tubular member, such as a casing string or riser. Accordingly, an apparatus for securing and tensioning a tubular member in a first fixed assembly, the apparatus comprising:

- a first engagement assembly, for securing the apparatus with respect to the tubular member;
- a second engagement assembly for engaging a tubular assembly and applying tension to the tubular assembly by longitudinal movement towards the tubular member.

In the apparatus, longitudinal movement of the second engagement assembly preferably secures the tubular assembly in the first fixed assembly, after which continued longitudinal movement applies tension to the tubular assembly.

In a preferred embodiment, the apparatus further comprises a piston, the second engagement assembly being attached to the piston, the piston being moveable in a longitudinal direction with respect to the tubular assembly. The piston is most conveniently moved by means of a hydraulic fluid.

Specific embodiments of the apparatus and method of the present invention will now be described in detail having reference to the accompanying drawings. The detailed description of these embodiments and the referenced drawings are by way of example only and are not intended to limit the scope of the present invention.

BRIEF DESCRIPTION OF THE DRAWINGS

Preferred embodiments of the present invention will now be described, by way of example only, having reference to the accompanying drawings, in which.

DETAILED DESCRIPTION OF THE PREFERRED EMBODIMENTS

Figure 1A:
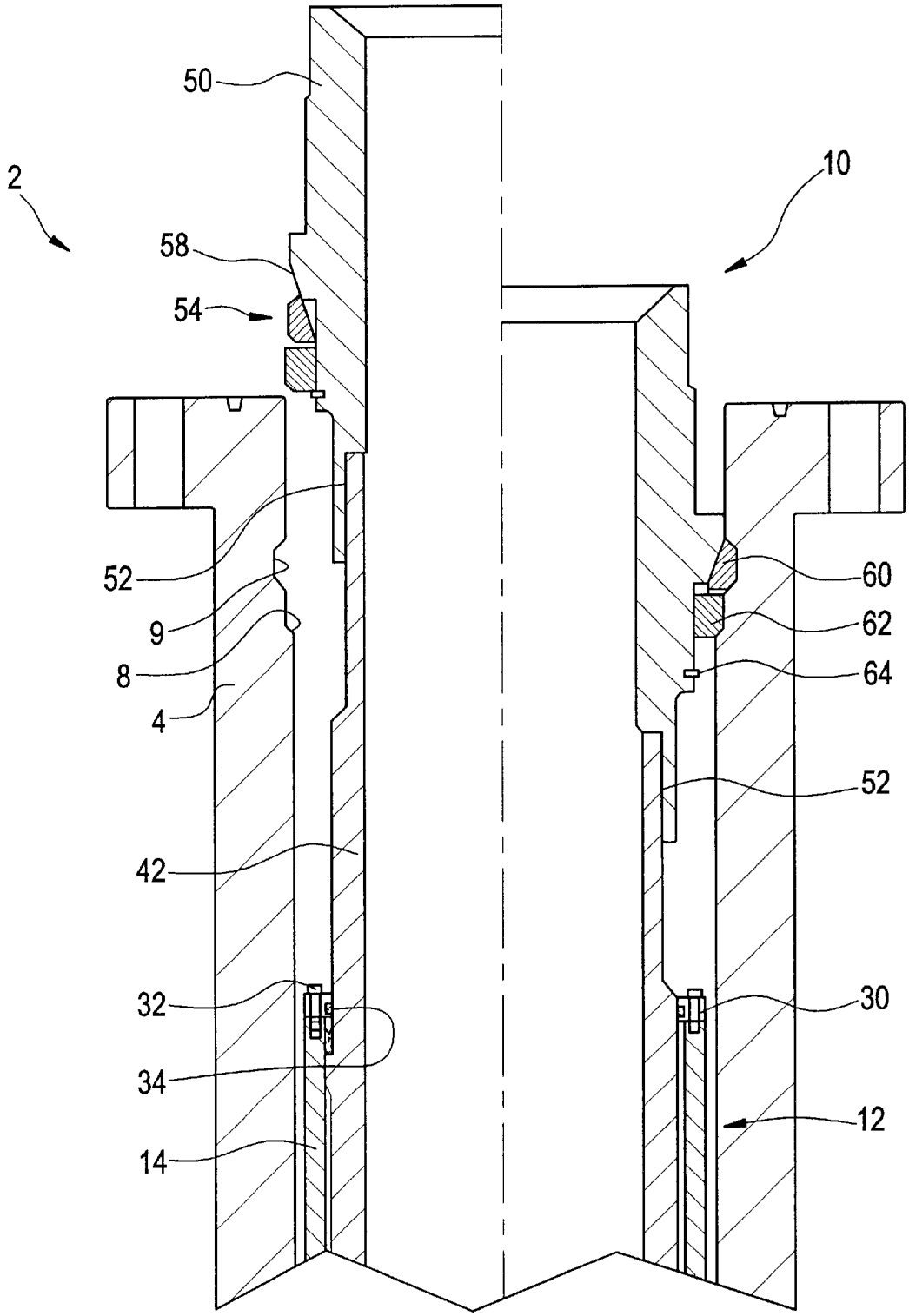
FIGS. 1*a* and 1*b* comprises a longitudinal cross-sectional view of an embodiment of the apparatus of the present invention in position within a surface wellhead and secured to a casing string, the portion of the figure to the left of the center line showing the apparatus in the disengaged, untensioned position, and the portion of the figure to the right of the center line showing the apparatus in the engaged, tensioned position.
Figure 1B:
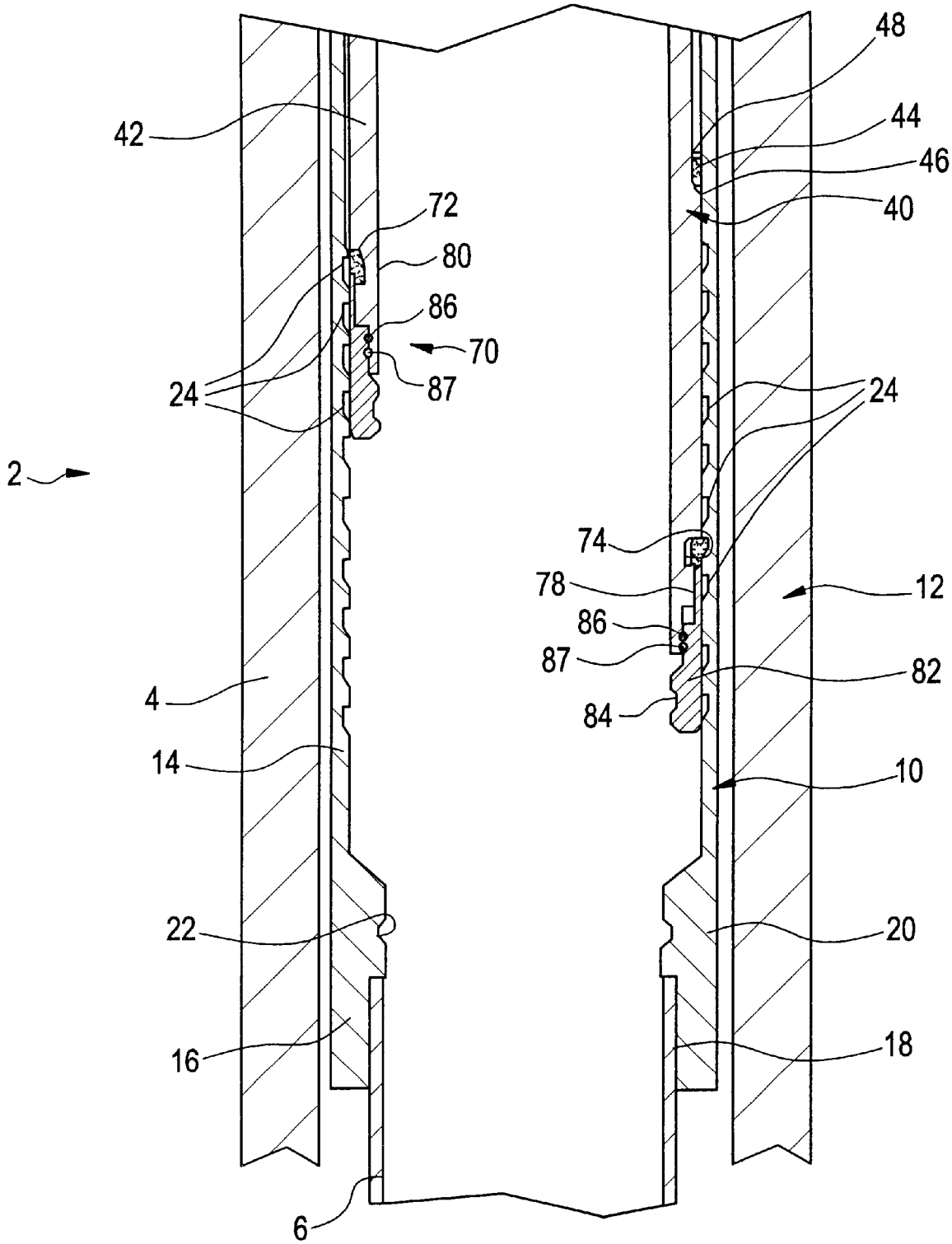

A surface wellhead assembly is shown in FIGS. 1*a* and 1*b* and generally referred to as 2. The wellhead assembly 2 comprises a surface wellhead 4. A casing string 6 extends between the surface wellhead 4 and a subsea wellhead (not shown). The surface wellhead 4 and casing string 6 are conventional design and well known in the art. The surface wellhead 4 is formed with an internal shoulder 8 on its inner surface. A landing groove 9 is formed in the inner surface of the surface wellhead 4 above the internal shoulder 8.

A casing securing and tensioning apparatus according to one embodiment of the present invention is shown in FIGS. 1*a* and 1*b*, generally indicated by the reference 10. The apparatus 10 comprises a first tubular assembly 12, in turn comprising an outer sleeve 14. The outer sleeve 14 is secured at its lower end 16 to the upper end of the casing string 6 by means of a threaded connection 18. Other means for connecting a tubular member to a casing string such as are known in the art may also be employed for this purpose. The lower end 16 of the outer sleeve 14 comprises a portion of increased wall thickness 20, having a circumferential groove 22 formed in its inner surface. The function of the groove 22 will be described further hereinbelow.

The outer sleeve 14 has a middle portion, having a plurality of circumferential locking grooves 24 formed into its inner surface. The lands between the grooves are each formed with a lower surface extending perpendicular to the inner surface of the outer sleeve, and an upper surface sloped at an acute angle to the longitudinal axis of the outer sleeve 14 downwards and inwards from the inner surface of the outer sleeve 14, as viewed in FIG. 1*b*. As described hereinafter, this arrangement allows the grooves 24 on the inner surface of the outer sleeve to be engaged in such as manner as to allow movement of the engaging means longitudinally towards the casing string 6, but to prevent movement of the engaging means longitudinally away from the casing string 6.

A support ring 30 is mounted on the upper end of the outer sleeve 14, by means of bolts 32. A ring seal 34 sits in a groove in the inner surface of the support ring 30.

The apparatus 10 further comprises a second tubular assembly 40, comprising an inner sleeve 42, extending concentrically into and movable longitudinally within the outer sleeve 14. The inner sleeve 42 is guided in its movement within the outer sleeve 14 by the support ring 30 on the upper end of the outer sleeve 14. The seal 34 bears against the outer surface of the inner sleeve 42. Further guidance for the inner sleeve 42 in its movement within the outer sleeve 14 is provided by a circumferential seal ring 44 disposed between the inner sleeve 42 and the outer sleeve 14 and moveable with the inner sleeve 42. The seal ring 44 is restrained in its movement by a shoulder 46, formed in the outer surface of the inner sleeve, 42 below the seal ring 44, and a ring 48 located in a groove in the outer surface of the inner sleeve 42 above the seal ring 44.

The second tubular assembly 40 further comprises a hanger 50 of a generally cylindrical form, mounted on the upper end of the inner sleeve 42 by means of a threaded connection 52. The hanger 56 comprises an engagement assembly, generally indicated as 54, on its outer surface. The engagement assembly 54 comprises a tapered load shoulder 58 formed in the outer surface of the hanger 50 and having a surface angled to extend downwards and inwards, as viewed in FIG. 1*a*. A tapered locking ring 60 is disposed around the hanger 50. The tapered locking ring 60 has an inner surface with a corresponding, but opposite angle to that of the angled surface of the tapered load shoulder 58. The tapered locking ring 60 is moveable longitudinally against the tapered load shoulder 58. A load ring 62 is disposed about the hanger 50 below the tapered locking ring 60, as viewed in FIG. 1*a*. The load ring 62 is moveable longitudinally along the outer surface of the hanger, restrained between the tapered load shoulder 58 and a retaining ring 64 seated in a groove in the outer surface of the hanger 50.

At its lower end, an engagement assembly, generally indicated as 70, is provided for engaging with the locking grooves 24 in the inner surface of the outer sleeve 14. The engagement assembly 70 comprises a locking ring 72 seated in a groove 74 in the outer surface of the inner sleeve 42. The groove 74 is of a sufficient size and depth so as to be able to accommodate the locking ring 72 such that the locking ring 72 does not extend beyond the surface of the inner sleeve 42. The locking ring 72 is sized, so as to be naturally biased into an engagement position, in which a portion of the locking ring 72 extends out of the groove 74 beyond the surface of the inner sleeve 42. As shown in the right hand portion of FIG. 1*b*, when the inner sleeve 42 is in the appropriate position, the locking ring 72 will engage with a locking groove 24 on the inner surface of the outer sleeve 14.

The engagement assembly 70 further comprises a tensioning collar 78 extending around and below the lower end of the inner sleeve 42. The tensioning collar 78 comprises a first sleeve portion 80 extending longitudinally towards the locking ring 72 from the lower end of the inner sleeve 42. The tensioning collar 78 further comprises an engagement portion 82 extending below the lower end of the inner sleeve 42, having a tensioning groove 84 formed in its inner surface. The tensioning collar 78 is moveable longitudinally between a first position, as shown in the left hand portion of FIG. 1*b*, and a second position, as shown in the right hand portion of FIG. 1*b*. In the first position, the tensioning collar 78 is in a raised position, in which the first sleeve portion 80 extends to the locking ring 72 and the groove 74, and holds the locking ring 72 fully within the groove 74. In the second position, the tensioning collar 78 is in a lowered position, in which the first sleeve portion 80 does not extend to the locking ring 72 and the groove 74. In this position, the bias of the locking ring 72 allows it to protrude from the groove 74. A shear pin 86 holds the tensioning collar 78 in the first position, until sheared, as described hereinafter. As an alternative to the shear pin 86, a shear ring may be employed. A retaining ring 87 retains the tensioning collar 78 on the lower end of the inner sleeve 42 and limits its movement.

Figure 2A:
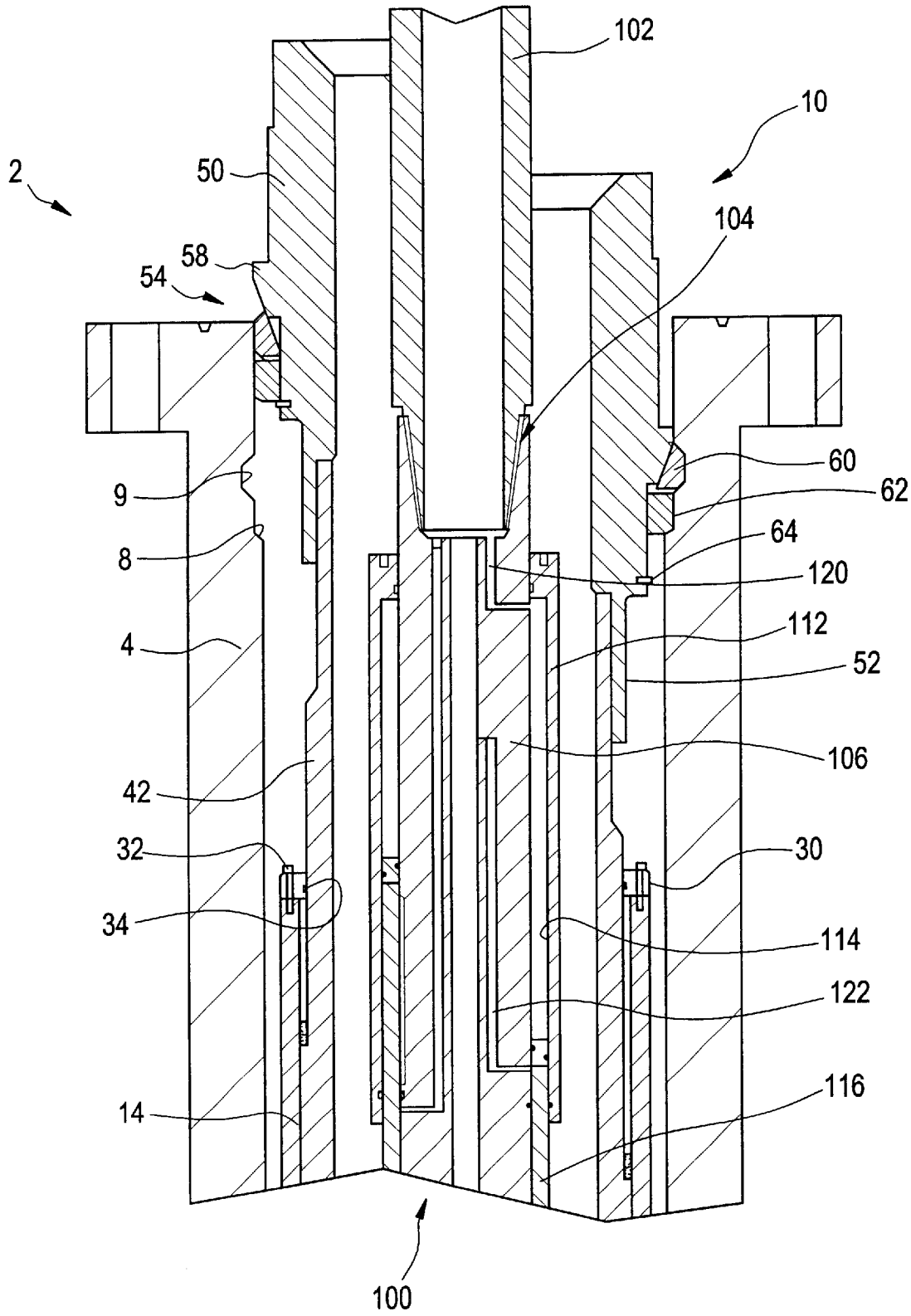
FIGS. 2*a* and 2*b* comprise the longitudinal cross-sectional view of FIG. 1, with a tool according to an embodiment of the present invention in place.
Figure 2B:
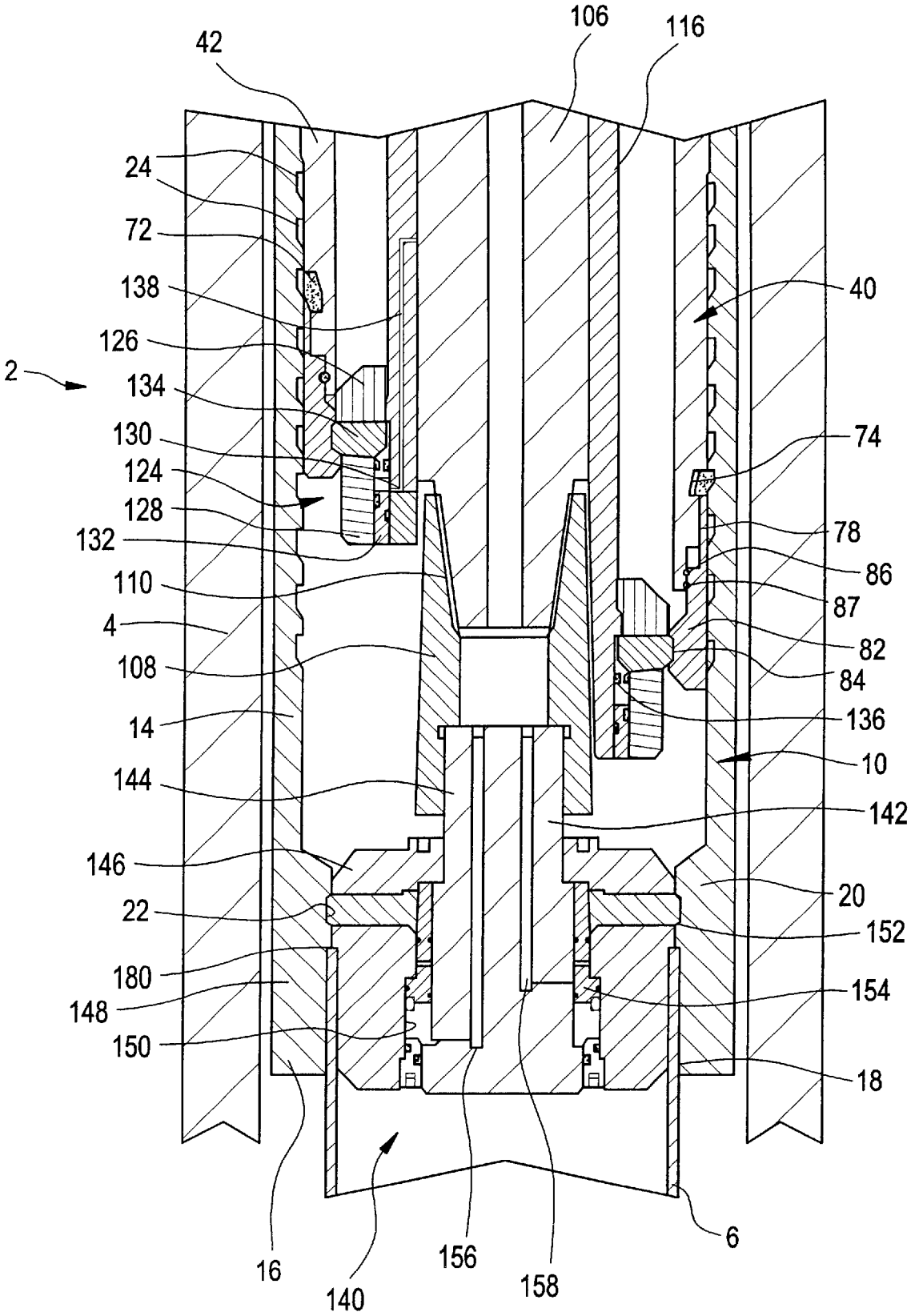

Referring to FIGS. 2*a* and 2*b*, there is shown the apparatus of FIGS. 1*a* and 1*b* in place in a surface wellhead with a tool inserted for placing and tensioning the apparatus and the casing string. The tool as shown in FIGS. 2*a* and 2*b* is generally indicated as 100. The tool 100 is suspended from a tubular string 102 by a conventional threaded connection 104. The tool 100 further comprises a generally cylindrical tool body 106 connected at its upper end to the tubular string 102 as described. A connector sleeve 108 is secured to the lower end of the tool body 106, again in a conventional manner using a threaded connection 110. A tubular piston sleeve 112 extends around the upper portion of the tool body 106 to provide an annular piston cavity 114 between the piston sleeve 112 and the tool body 106. A tubular piston 116 is slideable longitudinally within the piston cavity 114 along the outer surface of the tool body 106. A first conduit 120 is provided in the tool body 106 and connects with the upper portion of the piston cavity 114, through which hydraulic fluid may be provided to move the piston 116 in a downwards direction, as seen in FIGS. 2*a* and 2*b*. A second conduit 122 is provided in the tool body, opening into the lower portion of the piston cavity 114, through which hydraulic fluid may be provided in order to raise the piston 116 within the piston cavity 114, as seen in FIG. 2*a* and 2*b*.

A first locking assembly, generally indicated as 124, is mounted on the lower end portion of the piston 116. The first locking assembly 124 comprises upper and lower housing portions 126 and 128. A chamber 130 is formed between the lower housing portion 128 and the piston 116, which is sealed at its lower end by a sealing ring 132. Locking segments 134 extends between the upper and lower housing portions 126 and 128, and are moveable radially when acted upon by a hydraulic ring 136, which is moveable within the chamber 130. A piston conduit 138 is provided in the piston 116, through which hydraulic fluid can be supplied, in order to move the hydraulic ring 136. As shown in FIG. 2*b*, the hydraulic ring 136 is in its uppermost position, bearing against the locking segments 134, which are in turn held in engagement with the tensioning groove 84 in the inner surface of the tensioning collar 78. The locking segments 134 may be employed in conjunction with a locking ring to provide a higher load capacity for situations where needed.

The tool 100 further comprises a second locking assembly, generally indicated as 140 secured to its lower end. The second locking assembly 140 is similar in design and operation to the first locking assembly 124. The second locking assembly 140 comprises a locking assembly body 142, secured by a threaded connection 144 to the connector sleeve 108. The second locking assembly 140 further comprises upper and lower housing portions 146 and 148, which together define an annular chamber 150 with the locking assembly body 142. Locking segments 152 are moveable radially between the upper and lower housing portions 146 and 148, when acted upon by a piston 154 moveable longitudinally within the chamber 150. A first locking conduit 156 is provided in the locking assembly body 142, through which hydraulic fluid may be provided to the chamber 150 in order raise the piston 154. A second locking conduit 158 is provided in the locking assembly body 142, through which hydraulic fluid may be provided to the chamber 150 in order to lower the piston 154. As shown in FIG. 2*b*, the piston 154 is in the raised position and the locking segments 152 are engaged with the groove 22 in the end portion of the outer sleeve 14. Again, the locking segments 152 may be employed in conjunction with a locking ring to provide a higher load capacity when needed.

A shoulder 180 is formed in the inner surface of the lower end 16 of the outer sleeve 14 of the apparatus 10. As shown in FIG. 2*b*, a corresponding shoulder 182 on the outer surface of the lower housing portion 148 of the tool 100 seats against the shoulder 180 when the tool 100 is inserted. In this way, the shoulders 180 and 182 ensure that the tool 100 is correctly positioned within the apparatus.

To install the casing securing and tensioning apparatus and secure and tension the casing string 6 the followed procedure is applied. As a first step, the apparatus is connected by means of the outer sleeve 14 to the casing string 6 using the conventional threaded connection 18. At this point, the inner sleeve 42 is in the raised, unengaged position shown in the left hand portion of FIG. 1*a*. In this position, the tensioning collar 78 is in the raised position, such that the locking ring 72 is held fully within the groove 74. Thus, the inner sleeve 42 and the second tubular assembly 40 are free to move longitudinally within the outer sleeve 14.

To secure and tension the casing string 6, the tool 100 is inserted into the securing and tensioning apparatus 10, to extend within the inner sleeve 42 and the outer sleeve 14 toward the casing string 6. Hydraulic fluid is supplied under pressure through the first locking conduit 156 in the locking assembly body 142 into the chamber 150, thereby raising the piston 154 to bear against the locking segments 152, forcing it radially outwards into engagement with the groove 22 in the end portion of the outer sleeve 14. The hydraulic fluid is maintained under pressure in the chamber 150, in order to keep the locking segments 152 in the engaged position.

Thereafter, hydraulic fluid is supplied through the piston conduit 138 to the chamber 130 in the first locking assembly 132, thereby raising the hydraulic ring 136 to bear against the locking segments 134, forcing it radially outwards into engagement with the tensioning groove 84 in the tensioning collar 78. The hydraulic fluid is maintained under pressure in the chamber 130, in order to keep the locking segments 134 engaged with the tensioning groove 84.

The position of the entire assembly after the aforementioned locking operations have been completed is shown in the left hand portion of FIGS. 2*a* and 2*b*. In this position, the tool 100 is fully engaged with both the first and second tubular assemblies 12 and 40, with the second tubular assembly 40 in the raised position.

Once the two aforementioned locking operations have been completed, the steps may be taken in order to secure and tension the casing string 6. Hydraulic fluid is fed under pressure through the conduit 120 in the tool body 106 into the piston cavity 114, thereby urging the piston 116 longitudinally downwards towards the casing string 6. The action of the piston 116 causes the inner sleeve 42 and the second tubular assembly 40 to move longitudinally into the surface wellhead 4. The first result of this movement of the second tubular assembly 40 is that the load ring 62 of the engagement assembly 54 lands on the internal shoulder 8 within the surface wellhead 4. The second tubular assembly 40 continues its longitudinal movement, bringing the tapered locking ring 60 down to bear against the load ring 62. Continued movement of the second tubular assembly 40 urges the tapered locking ring outwards against the tapered load shoulder 58 on the hanger 50 and into engagement with the landing groove 9 in the surface wellhead 4. At this point, further longitudinal movement of the second tubular assembly 40 is prevented. The engagement of the engagement assembly 54 with the shoulder 8 and groove 9 in the surface wellhead is shown in the right hand portion of FIGS. 1*a* and 2*a*.

The supply of hydraulic fluid to the piston cavity 114 is maintained, causing the piston 116 to continue its longitudinal movement towards the casing string 6. With the engagement assembly 54 restraining further movement of the second tubular assembly 40, further movement of the piston 116 applies tension to the inner sleeve 42. At a given applied tension, the shear pin 86 retaining the tensioning collar 78 shears, allowing the tensioning collar 78 to move longitudinally with respect to the inner sleeve 42. This in turn releases the locking ring 72 from the groove 74. The bias of the locking ring 72 urges it into engagement with the corresponding groove 24 in the inner surface of the outer sleeve 14. This position is shown in the right hand portion of FIGS. 2*a* and 2*b*.

At this point, the casing string 6 is secured and held under tension. Further tension may be applied by increasing the pressure of the hydraulic fluid in the piston cavity 114, forcing the piston further towards the casing string 6. As noted above, the grooves 24 and the corresponding lands in the inner surface of the outer sleeve 14 are formed to allow the locking ring 72 to move longitudinally towards the casing string 6. As further tension is applied to the outer sleeve 42, the locking ring 72 engages with successive grooves 24 as it moves towards the casing string 6.

Once the requisite tension has been applied to the casing string 6, the supply of hydraulic fluid to the piston cavity 114 is shut off. Thereafter, the supply of hydraulic fluid to the chamber 130 of the first locking assembly 124 is shut off, thus releasing the locking segments 134 from their engagement with the groove 84 in the tensioning collar 78. Finally, the supply of hydraulic fluid to the chamber 150 of the second locking assembly 140 is removed. Hydraulic fluid is supplied through the second conduit 158 in the locking assembly body 142, to lower the piston 154, in turn releasing the locking segments 152 from engagement with the groove 22 in the outer sleeve 14. The tool 100 may then be removed.

The aforementioned procedure may be used in reverse to remove the securing and tensioning apparatus 10 and release the casing string 6.

The method and apparatus of the present invention have been described with respect to the installation and tensioning of a casing string in a surface wellhead. However, it is to be understood that the method and apparatus may be employed to secure and tension any suitable tubular member, including the legs and other tensioned members of a tension leg platform, as well as other tubular members employed in offshore drilling and production operations and other applications.

While the preferred embodiments of the present invention have been shown in the accompanying figures and described above, it is not intended that these be taken to limit the scope of the present invention and modifications thereof can be made by one skilled in the art without departing from the spirit of the present invention.

What is claimed is:

1. Apparatus for securing a tubular member under tension, the member secured to and extending between a first and second fixed assembly, the apparatus comprising:

a first tubular assembly connectable at a first region to the tubular member to be tensioned;

a second tubular assembly having a first and a second engageable portion, the second tubular assembly being arranged concentrically with respect to the first tubular assembly and movable longitudinally with respect to the first tubular assembly;

a first engagement assembly for engaging the first engageable portion of the second tubular assembly with the first fixed assembly, such that movement of the second tubular assembly toward the tubular member to be tensioned is prevented, the first engagement assembly comprises a locking collar, the locking collar for engaging a shoulder in the first fixed assembly and the first engagement assembly further comprises a locking ring for engaging a groove in the first fixed assembly;

a second engagement assembly for engaging the second engageable portion of the second tubular assembly with the first tubular assembly upon longitudinal movement of the second engageable portion of the second; tubular assembly with respect to the first tubular assembly toward the tubular member, the second engageable portion of the second tubular assembly extends concentrically within the first tubular assembly;

wherein the second tubular assembly can be placed under tension by moving its second engageable portion longitudinally relative to its first engageable portion, when the first engageable portion is engaged with the first fixed assembly.

2. Apparatus as claimed in claim 1, wherein the locking collar is movable longitudinally with respect to the second tubular assembly upon contact with the shoulder in the first fixed assembly, such movement urging the locking ring into engagement with the groove in the first fixed assembly.

3. Apparatus as claimed in claim 1, wherein the second engagement assembly allows the second engageable portion of the second tubular assembly, when engaged with the first tubular assembly, to move away from the first engageable portion of the second tubular assembly.

4. Apparatus as claimed in claim 1, wherein the second engagement assembly allows the second engageable portion of the second tubular assembly to engage with the first tubular assembly in one of a plurality different positions.

5. Apparatus as claimed in claim 1, wherein the second engagement assembly has a first operating mode, in which engagement between the first and second tubular assemblies is not possible, and a second operating mode, in which engagement between the first and second tubular assemblies is possible.

6. Apparatus as claimed in claim 5, wherein the second engagement assembly is moved from the first operating mode to the second operating mode upon the application of a predetermined tension to the second tubular assembly.

7. Apparatus as claimed in claim 1, wherein the first tubular assembly is connectable at its first engageable portion to a tubular member selected from the group consisting of a casing string, a riser, and the leg of a tension leg platform.

8. Apparatus as claimed in claim 1, wherein the first engageable portion of the second tubular assembly is engageable with a surface wellhead.

9. Apparatus for securing a tubular member under tension, the member secured to and extending between a first and second fixed assembly, the apparatus comprising:

a first tubular assembly connectable at a first region to the tubular member to be tensioned;

a second tubular assembly having a first and a second engageable portion, the second tubular assembly being arranged concentrically with respect to the first tubular assembly and movable longitudinally with respect to the first tubular assembly;

a first engagement assembly for engaging the first engageable portion of the second tubular assembly with the first fixed assembly, such that movement of the second tubular assembly toward the tubular member to be tensioned is prevented;

a second engagement assembly for engaging the second engageable portion of the second tubular assembly with the first tubular assembly upon longitudinal movement of the second engageable portion of the second tubular assembly with respect to the first tubular assembly toward the tubular member;

wherein the second tubular assembly can be placed under tension by moving its second engageable portion longitudinally relative to its first engageable portion, when the first engageable portion is engaged with the first fixed assembly, and;

wherein the second engagement assembly comprises a first groove in the first tubular assembly and a second groove in the second tubular assembly, the second engagement assembly further comprising a locking ring for engaging both the first groove and the second groove, and;

wherein a plurality of first grooves are provided, thereby allowing the second engageable portion of the second tubular assembly to engage the first tubular assembly in a plurality of different positions.

10. Apparatus as claimed in claim 9, wherein the locking ring of the second engagement assembly is held completely within the second groove in the second tubular assembly until a predetermined tension is applied to the second tubular assembly.

11. Apparatus as claimed in claim 10 wherein the second tubular assembly comprises a tensioning collar at its second engageable portion, the tensioning collar being engageable by a tool for tensioning the second tubular assembly.

12. Apparatus as claimed in claim 11, wherein the tensioning collar is movable between a first position, in which the tensioning collar holds the locking ring completely within the second groove, and a second position, in which the locking ring is released to engage the first groove.

13. Apparatus as claimed in claim 12, wherein the locking ring is biased into engagement with the first groove, the tensioning collar holding the locking ring against its bias in the first position.

14. Apparatus as claimed in claim 12, wherein the tensioning collar moves from the first position into the second position at a predetermined tension applied to the second tubular assembly.

15. A method for securing and tensioning a tubular member, the tubular member extending between a first fixed assembly and a second fixed assembly, the method comprising:

securing a first tubular assembly to the tubular member;

providing a second tubular assembly, having a first engageable portion and a second engageable portion;

securing the second tubular assembly at its first engageable portion to the first fixed assembly, such that the first tubular assembly is prevented from moving towards the tubular member;

applying tension to the second tubular assembly by moving the second engageable portion away from the first engageable portion by applying a force longitudinally to the second tubular assembly;

engaging the second engageable, portion of the second tubular assembly with the first tubular assembly, wherein the second engageable portion of the second tubular assembly is selectively engaged with the first tubular assembly and the second engageable portion of the second tubular assembly is engaged with the first tubular assembly upon application of a predetermined tension to the second tubular assembly; and wherein an engagement assembly is provided to engage the second engageable portion of the second tubular assembly with the first tubular assembly, the engagement assembly being biased into an engaged position, the engagement assembly being held in a disengaged position until application of the predetermined tension to the second tubular assembly.

16. The method as claimed in claim 15, wherein the second tubular assembly is moved longitudinally from a disengaged position to an engaged position, in which the second tubular assembly is engaged with the first fixed assembly, the longitudinal movement of the second tubular assembly being continued to tension the second tubular assembly and engage the second tubular assembly with the first tubular assembly.

17. The method as claimed in claim 15, wherein the second engageable portion of the second tubular assembly is engageable with first tubular member in a plurality of positions.

18. A method for securing and tensioning a tubular member, the tubular member extending between a first fixed assembly and a second fixed assembly, the method comprising:

securing a first tubular assembly to the tubular member;

providing a second tubular assembly, having a first engageable portion and a second engageable portion;

securing the second tubular assembly at its first engageable portion to the first fixed assembly, such that the first tubular assembly is prevented from moving towards the tubular member;

applying tension to the second tubular assembly by moving the second engageable portion away from the first engageable portion by applying a force longitudinally to the second tubular assembly;

engaging the second engageable portion of the second tubular assembly with the first tubular assembly, and;

wherein the second tubular assembly is tensioned by a longitudinal force applied by means of a pressurized hydraulic fluid to the second engageable portion of the second tubular assembly.

19. Apparatus for securing and tensioning a tubular member in a first fixed assembly, the apparatus comprising:

a first engagement assembly, for securing the apparatus with respect to the tubular member;

a second engagement assembly for engaging a tubular assembly and applying tension to the tubular assembly by longitudinal movement towards the tubular member, and;

a piston, the second engagement,assembly being attached to the piston, the piston being moveable in a longitudinal direction, with respect to the tubular assembly and the piston is moved by a hydraulic fluid.

20. Apparatus as claimed in claim 19, wherein longitudinal movement of the second engagement assembly secures the tubular assembly in the first fixed assembly, after which continued longitudinal movement applies tension to the tubular assembly.

* * * * *